United States Patent [19]

Herbulot

[11] Patent Number: 4,513,601

[45] Date of Patent: Apr. 30, 1985

[54] METHOD FOR LOCALLY DEFORMING A ROUND TUBE INTO A TUBE COMPRISING PLANAR SURFACES AND A FORMING PUNCH FOR CARRYING OUT SAID METHOD

[75] Inventor: Alain Herbulot, Valentigney, France

[73] Assignee: Cycles Peugeot, Valentigney, France

[21] Appl. No.: 426,535

[22] Filed: Sep. 29, 1982

[30] Foreign Application Priority Data

Oct. 9, 1981 [FR] France ..... 81 19036

[51] Int. Cl.[3] ..... B21D 41/00

[52] U.S. Cl. ..... 72/398; 138/116

[58] Field of Search ..... 72/370, 398, 416, 471, 72/479; 138/116, 115, 111, 117

[56] References Cited

U.S. PATENT DOCUMENTS

| | | | |
|---|---|---|---|
| 1,983,584 | 12/1934 | Urschel | 72/370 |
| 2,205,893 | 6/1940 | Unger | 72/416 |
| 3,476,869 | 11/1969 | Hawkins | 138/115 |
| 3,719,985 | 3/1973 | Federspill | 72/370 |
| 4,256,146 | 3/1981 | Genini et al. | 138/111 |
| 4,372,035 | 2/1983 | McMillen | 72/370 |

*Primary Examiner*—Francis S. Husar
*Assistant Examiner*—Linda McLaughlin
*Attorney, Agent, or Firm*—Sughrue, Mion, Zinn, Macpeak and Seas

[57] ABSTRACT

The forming punch (18) comprises two planar surfaces (20, 22) interconnected by an edge (23), two portions of a cylinder which passes through the edge (23) and a curved surface centered on this edge. This punch (18) is inserted in the tube to the point of the tube to be deformed and then the tube is compressed between a V-shaped groove (34) in a die (36) and a curved groove (40) in a compression member (38). The punch (18) is thereafter withdrawn from the tube by axially sliding the punch out of the latter.

9 Claims, 7 Drawing Figures

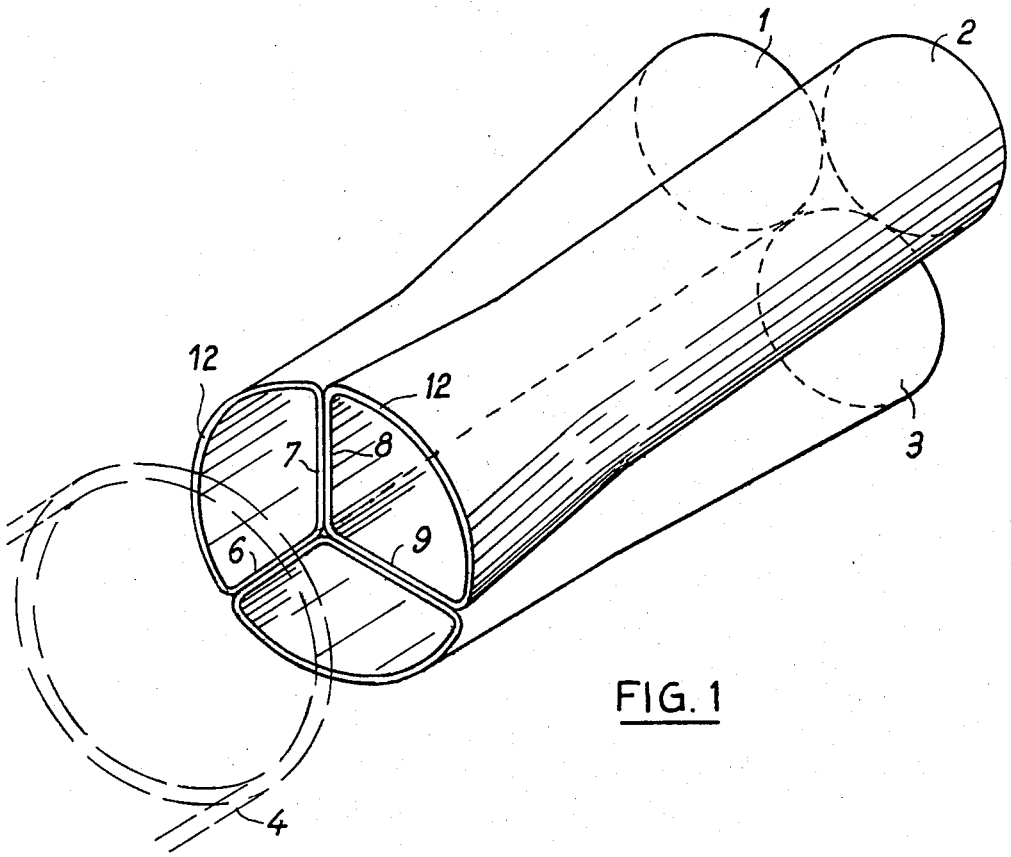
FIG. 1
FIG. 2
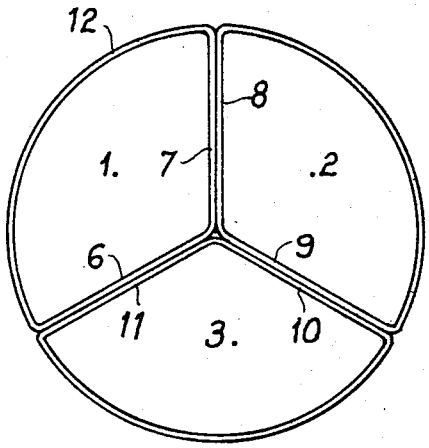
FIG. 3
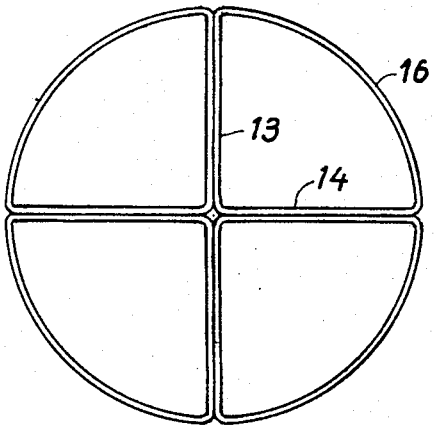

METHOD FOR LOCALLY DEFORMING A ROUND TUBE INTO A TUBE COMPRISING PLANAR SURFACES AND A FORMING PUNCH FOR CARRYING OUT SAID METHOD

Tubes employed in industry usually have a circular section owing to the ease with which they manufactured continuously from reels of sheet material on tube forming machines and also owing to their mechanical properties. However, this circular shape gives rise to problems when it is required to carry out certain operations, such as the drilling of a tube, the welding thereof with other parts, its assembly with other tubes and in particular the assembly of a plurality of similar tubes so as to enable them to open into another tube of larger section.

An object of the present invention is to overcome these drawbacks and to permit the forming of local planar surfaces on the tube.

The invention indeed provides a method for locally deforming a round tube into a tube having a substantially triangular section, comprising axially introducing in the tube an elongated punch comprising a dihedron between two guiding surfaces, placing in position the portion of the tube to be deformed, which contains the punch, on the lateral walls of a V-shaped groove of the upper surface of a die, then applying on the outer free surface of the tube a compression member which is also provided with a groove, and exerting a force thereon until it comes into contact with the die and the tube and punch penetrate the inner end of the V-shaped groove so that the tube portion conforms to the contour of the space defined between the grooves of the die and the compression member whose section is substantially triangular, and then separating the compression member and the die and withdrawing the punch from the tube.

The tube formed in this way has, only on a portion of its length, a substantially triangular section but only its shape has been modified so that its mechanical properties have not been altered but on the other hand its adaptation for fixing it to, or placing it alongside, other members is distinctly improved.

The invention also relates to a forming tool or punch for carrying out said method, this punch comprising a dihedron having a given angle between two narrow guiding and centering surfaces, the edge of the dihedron and the edges of the ends of the two lateral surfaces being generatrices of the same cylinder.

According to a preferred embodiment, the tool comprises, on the side thereof opposed to the edge of the dihedron, a curved surface having a radius whose centre coincides with said edge.

As the cylinder on which the edges of the tool are placed has a diameter very slightly less than that of the tube to be deformed, the tool may be easily inserted in the tube to the desired point and even withdrawn from this tube after the deformation of the latter. Moreover, it is always perfectly centered in the tube and may be easily centered relative to the die.

The ensuing description will bring out the advantages and features of the invention.

In the accompanying drawings:

FIG. 1 is a perspective view of the grouping or bringing together of a plurality of tubes deformed according to the method of the invention;

FIG. 2 is an end elevational view, to a slightly enlarged scale, of the tubes shown in FIG. 1;

FIG. 3 is a view similar to FIG. 2 of another application of the invention;

Figure 4:
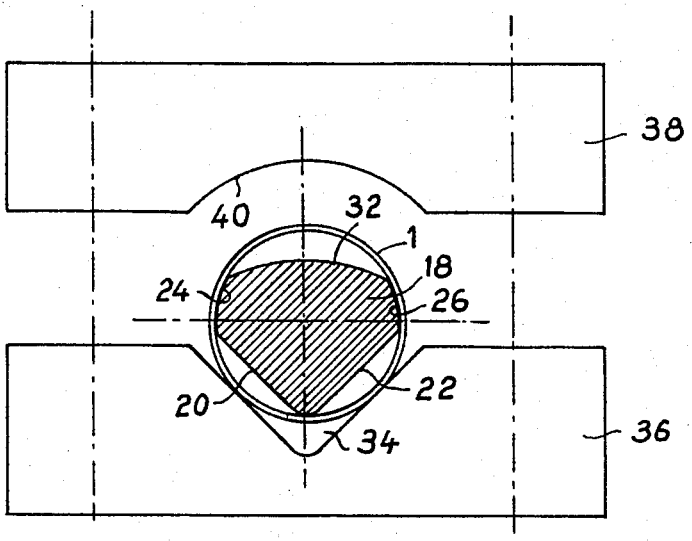
FIGS. 4 and 5 illustrate two stages of the method for deforming the tube, namely respectively before and after the compression of the latter.

FIGS. 1 and 2 illustrate a particularly interesting application of the invention. They show three tubes of circular section 1, 2, 3 which are disposed in side-by-side relation and parallel to each other in the extension of a tube 4 of larger diameter. Each of the tubes 1, 2 and 3 is deformed in the end portion thereof in the vicinity of the tube 4 so as to comprise two planar surfaces, respectively, 6, 7, 8, 9 and 10 and 11 which are capable of being brought against the corresponding surface of one of the other two tubes. The two planar surfaces 6, 7 are interconnected by a curved surface constituting a portion of a circle 12 whose diameter exceeds the diameter of the initial tube 1, 2 or 3, each of the surfaces 12 forming a third of a circle so that the assembly of three deformed tubes 1, 2 and 3 is defined externally by a circumference constituted by the succession of three surfaces 12, as can be seen clearly in FIG. 2.

The outside diameter of the assembly of the three deformed tubes is equal to, or preferably slightly less than, the inside diameter of the tube 4, so that the three tubes 1, 2 and 3 can be easily connected to the tube 4 and open onto the interior of the latter.

It will be understood that a connection can be achieved in a similar way when the tubes of circular section are in a number exceeding three, for example four, as shown in FIG. 3. In this case, the angle made between the planar surfaces 13 and 14 and the subtended angle of the arc of the corresponding curved surface 16 are 90° instead of 120°.

Figure 6:
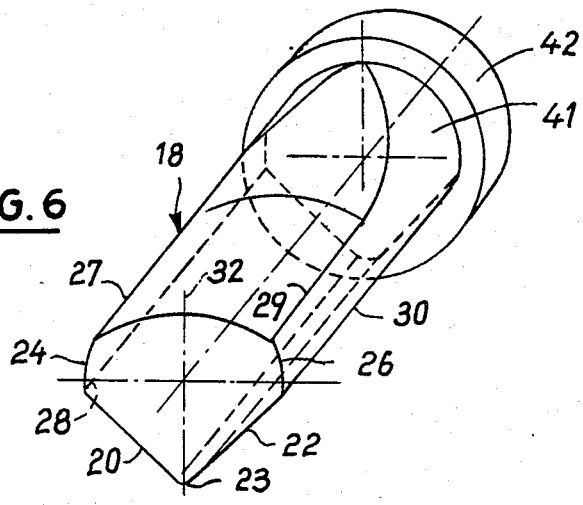
FIG. 6 is a perspective view of a forming punch according to the invention.

Irrespective of the value of the angle of the dihedron which the planar surfaces of the tube of circular section must form, the deformation is achieved by means of a forming tool or punch such as that shown in FIG. 6. This punch 18 is formed from a bar of solid metal having a circular section whose radius is close to, or very slightly less than, the internal radius of the tube to be formed, for example the tube 1 shown in FIG. 4. This punch 18 has two planar surfaces, respectively 20 and 22, which meet on an edge 23 and thereby form a dihedron whose angle corresponds to that which is desired to be obtained on the tube 1. Each of the planar surfaces 20 and 22 meet a portion of a cylinder 24, 26 respectively of the initial bar and the edge 23 of the dihedron formed by the surfaces 20 and 22 is located practically on a generatrix of the cylinder of the outer surface of this bar. Consequently, the edges 27, 28, 29, 30 of the lateral surfaces 24 and 26 and the edge 23 of the dihedron constitute generatrices of the same cylinder.

Further, in a part facing the apex 23 of the dihedron, the lateral surfaces 24 and 26 are interconnected by a surface 32 which is also curved but has its axis coincident with the edge 23.

The punch 18 may possess any desired length, but its cross-section remains inscribed within a circle of a diameter at the most equal to the inside diameter of the tube. This punch 18 may thus be easily inserted in the end of a tube which must be deformed, for example in the left end of the tubes shown in FIG. 1. The lateral surfaces 24 and 26 then perform the function of guiding and centering means.

The tube portion containing the punch 18 is then placed in a V-shaped groove 34 provided in the upper part of a die 36, the dihedron 20, 22, 23 of the punch being exactly centered relative to the groove 34 while the tube 1 bears tangentially on the two inclined walls of the groove but projects out of the latter (FIG. 4).

A compression member 38, also comprising a groove 40, is then lowered onto the tube 1 and then urged against the latter, which it urges into the groove 34, until itself comes into contact against the die 36. In the course of the displacement of the member 38, the inner end of the groove 40 urges the upper portion of the tube 1 against the curved surface 23 of the punch 18 and then urges the punch into the groove 34 by deforming the lower portion of the tube 1 which is applied against the two planar surfaces 20 and 22 of the punch 18.

Figure 5:
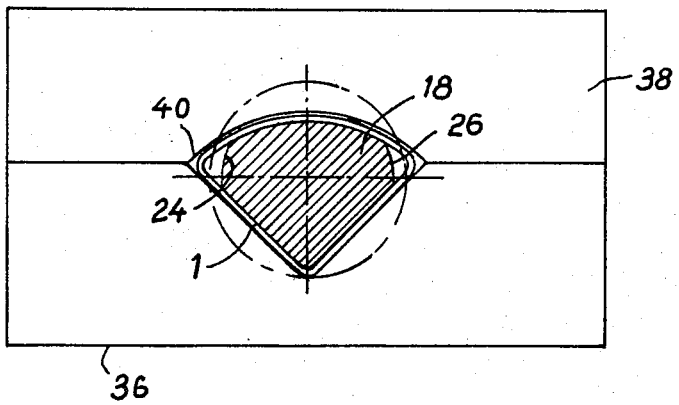

When the member 38 comes into contact with the die 36, the groove 40 closes the groove 34 and defines therewith a cavity whose cross-section has substantially the shape of a triangle. Preferably, as shown in the drawings, the groove 40 has a curved shape, its radius of curvature being very close to that of the upper cylindrical surface 32 of the punch so that the tube 1 deformed by the compression assumes, as shown in FIG. 5, also a cross-section in the shape of a triangle having one curved side. Indeed, at this moment, the tube 1 substantially conforms to the shape of the cavity defined by the grooves 40 and 34 and is moreover applied against the punch 18.

However, as shown in particular to FIG. 5, the lateral surfaces 24 and 26 at the end of the compression are free so that the punch 18 can slide inside the tube 1, even after the deformation of the latter. Consequently, after the compression member 38 and the die 36 have been separated from each other, the punch 18 is withdrawn from the tube 1 which is ready for use, i.e. possibly assembled with other identical tubes in the manner shown in FIGS. 1 to 3.

Preferably, as shown in FIG. 6, the punch 18 is connected by a transition portion 41 to a handling knob 42. The active part of the forming tool or punch 18 may be relatively short, as shown in FIG. 6, or have a much greater length and thereby permit the deformation of a part of the tube which is relatively remote from its open end.

Figure 7:
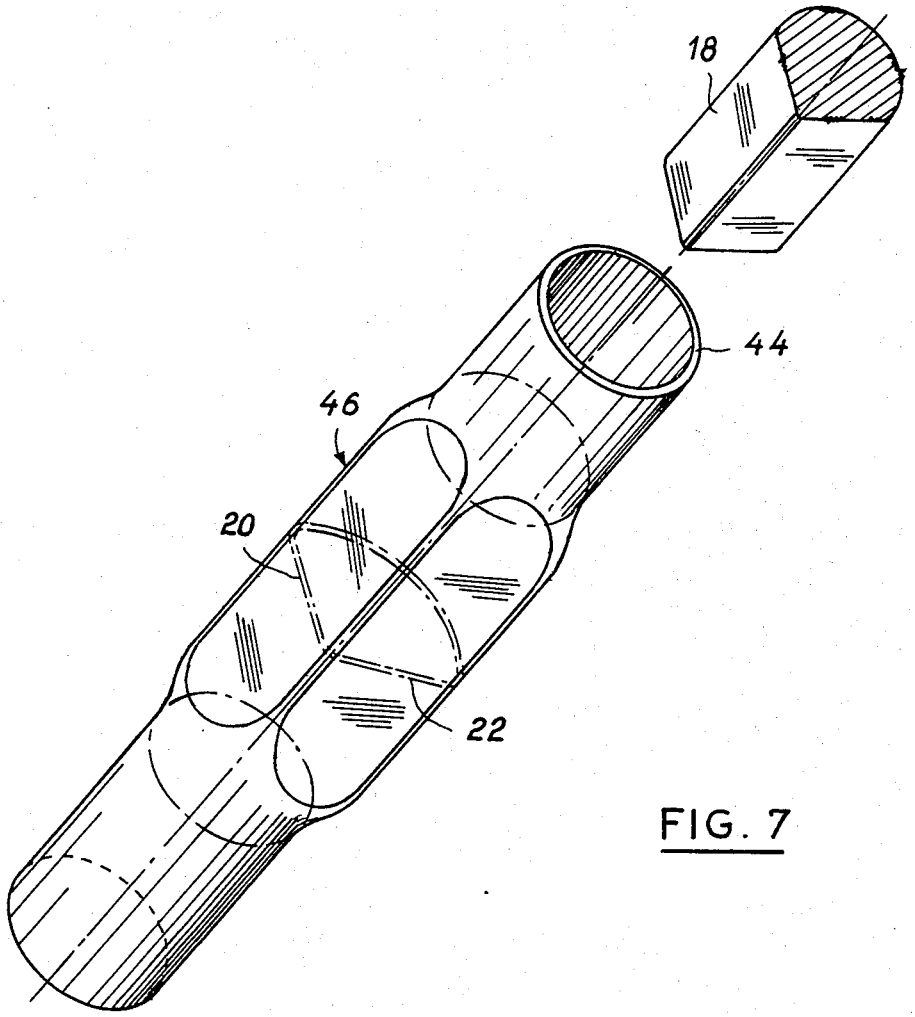
FIG. 7 is a perspective view of another embodiment of a tube which has been locally deformed by the method according to the invention.

For example, as in the embodiment shown in FIG. 7, a punch 18 of great length may be inserted in a tube 44 of circular section and reach a median part 46. The tube portion 46 containing the punch 18 is then placed in the die 36 and compressed by the member 38 in the manner described in respect of the tube 1. In this case, as in the foregoing case, the axial length of these two elements, ie. the die and the compression member 38, and the length of the grooves 34 and 40 which are open at their two ends, correspond to the length of the portion of tube that it is desired to deform. Consequently, in the embodiment shown in FIG. 7, the length of the grooves 34 and 40 employed correspond to the length of the tube portion 46. Thus, only this portion is deformed, the rest of the tube 44 retaining its circular section.

It will be understood that the angle of the dihedron formed by the planar surfaces 20 and 22 of the portion 46 may vary and be chosen as a function of the particular application intended for the tube 44.

In any case, only the shape of the section of the tube is modified. The material itself retains its particular properties so that the deformation does not result in a weakening of the strength of the tube but, on the contrary, facilitates the fixing and the assembly thereof with other tubes or with planar or other members.

When a plurality of tubes are intended to be placed in adjoining relation in the manner shown in FIGS. 1 to 3, it is often advantageous to deform them simultaneously. A punch 18 is then inserted in each of the tubes 1, 2 and 3, for example, and then these tubes are pressed against each other by compression members in the shape of portions of a cylinder which urge them together in such manner that they are deformed upon their reciprocal contact. Each tube abuts against the V-shaped grooves that the two adjacent tubes form progressively upon conforming to the shape of the punches they contain.

No abnormal deformation appears when the pressure is equally distributed along the three tubes and the punches are urged together until they are spaced from each other along their surfaces defining the radii of their sector of a circle by the interposition of the walls of the adjoining tubes, which walls assume the configuration of the surfaces of the punches defining the radii. On the other hand, the withdrawal of the punches remains easy.

It is therefore possible to deform in this way already installed tubes simultaneously at the moment of their assembly, for example with another tube of larger diameter, which considerably facilitates the assembly of these tubes.

Having now described my invention what I claim as new and desire to secure by Letters Patent is:

1. A method for locally deforming a portion of a tube having an initial cylindrical wall of round section into a deformed tube portion having a wall which has parallel generatrices parallel to said initial cylindrical wall and an outer surface having a section in the shape of a sector of a circle, which circle has its centre substantially in axial alignment with the outer surface of said initial cylindrical wall, said method comprising axially inserting in the tube of round section an elongated punch having an outer surface which has parallel generatrices and a section in the shape of a sector of a circle with truncated corners between the circular part of the sector and the radii of the sector of the circle; placing said portion of the tube to be deformed containing the punch which has its generatrices parallel to said initial cylindrical wall on inclined lateral walls of a V-shaped groove of a die, which groove has parallel generatrices parallel to said initial cylindrical wall of the tubes, the V defining an angle identical to the angle defined by the radii of the sector of the punch; then applying on an outer free surface of said initial cylindrical wall of the tube a compression member which is also provided with a groove which has parallel generatrices parallel to said initial cylindrical wall of the tube and a section having a radius identical to the radius of the circular outer surface of the deformed tube; exerting a force on the compression member until it causes the tube to contact the radiused part of the sector of the punch and causes the tube and punch to penetrate to an inner end of the V-shaped groove so that the tube conforms to the contour of a cavity defined by the grooves of the die and compression member and the section of the tube has said shape of a sector of a circle; then separating the compression member and the die; and axially withdrawing the punch from the tube.

2. A method according to claim 1, comprising inserting the punch in the end of the tube to be deformed and then placing said end between the die and the compression member.

3. A method according to claim 1, comprising inserting the punch which is of relatively great length until an intermediate part of the tube is reached and placing said intermediate part of the tube in the V-shaped groove of the die.

4. A method according to claim 1, wherein said truncated corners define portions of a cylinder which has a diameter slightly less than the inside diameter of the tube to be deformed, said punch being previously cut from a round bar having the same diameter as said portions of a cylinder.

5. A forming apparatus comprising a die, a compression member and a forming punch for locally deforming a cylindrical tube having a wall of circular section, said punch having parallel generatrices and a section in the shape of a sector of a circle with truncated corners between the circular part of the sector and the radii of the sector of the punch, said truncated corners being inscribable within the circular inner surface of the wall of the tube of circular section and capable of centering the punch relative to the inner surface of the tube, the radii of the sector of the punch intersecting in a region which is also inscribable within said circular inner surface of the wall of the tube, said die having a V-section groove which has parallel generatrices, the branches of the V of the groove making an angle identical to the angle made by the radii of the sector of the punch, and the compression member defining a part-cylindrical groove having in section a radius of curvature larger than said radius of curvature of said sector of said punch to an extent corresponding to the thickness of the wall of said cylindrical tube, the generatrices of said V-section groove, said punch, and said part-cylindrical groove being parallel to one another.

6. An apparatus according to claim 5, wherein the groove of the die and the groove of the compression member have a width exceeding the diameter of the cylindrical tube to be deformed.

7. An apparatus according to claim 5, wherein the axial dimensions of the die and compression member correspond to the length of the desired deformation of the tube.

8. An apparatus according to claim 5, wherein the angle made between the radii of the sector of the punch is at the most equal to 120°.

9. A method for locally deforming a portion of an assembly of a plurality of cylindrical tubes which are in adjoining relation to each other with their axes parallel to each other and inscribed within a first circle so that the deformed portion of said assembly of tubes is inscribed within a second circle having a diameter less than said first circle and has parallel generatrices parallel to the axes of said tubes, said method comprising placing said tubes in parallel adjoining relation to each other, inserting an elongated punch in each tube, which punch has parallel generatrices parallel to the axis of the respective tube and a section in the shape of a sector of a circle with truncated corners between a surface defining in section a circular part of the sector and two surfaces defining in section two radii of the sector, exerting a simultaneous thrust radially of each tube by means of a compression member which has a groove having parallel generatrices parallel to the axis of the respective tube and a radius of curvature in section corresponding to the radius of curvature of said second circle, so as to deform said tubes until said thrust causes said tubes to be deformed to the extent that said deformed portion of said assembly of tubes becomes inscribed within said second circle and said punches are spaced from each other along their surfaces defining the radii of their sector of a circle by the interposition of the walls of the adjoining tubes, which walls assume the configuration of said surfaces of the punches defining said radii, and withdrawing the punches from the respective tubes.

* * * * *